US007596894B1

(12) United States Patent
Currey

(10) Patent No.: US 7,596,894 B1
(45) Date of Patent: Oct. 6, 2009

(54) BUCKET WITH DUST SUPPRESSING APPARATUS

(76) Inventor: Albert Ben Currey, 46631 N. 11th Ave., Phoenix, AZ (US) 85087

( * ) Notice: Subject to any disclaimer, the term of this patent is extended or adjusted under 35 U.S.C. 154(b) by 0 days.

(21) Appl. No.: 12/182,040

(22) Filed: Jul. 29, 2008

(51) Int. Cl.
*E02F 3/40* (2006.01)

(52) U.S. Cl. ..... 37/444

(58) Field of Classification Search ..... 37/403–410, 37/466, 442, 444; 172/324–328, 458, 502, 172/668, 701; 405/129.9, 270, 38, 258.1
See application file for complete search history.

(56) References Cited

U.S. PATENT DOCUMENTS 5,199,196 A * 4/1993 Straley ..... 37/442
6,171,024 B1 * 1/2001 Curtis et al. ..... 405/128.45
6,253,136 B1 * 6/2001 Stratton et al. ..... 701/50
6,311,781 B1 * 11/2001 Jerke ..... 169/62
6,558,080 B2 * 5/2003 Kozak ..... 405/129.9
7,445,122 B2 * 11/2008 Currey ..... 209/674

* cited by examiner

*Primary Examiner*—Robert E Pezzuto
(74) *Attorney, Agent, or Firm*—Schmeiser, Olsen & Watts, LLP

(57) ABSTRACT

A bucket with a dust suppressing apparatus includes a bucket portion and a dust suppressing apparatus coupled to the bucket portion. The dust suppressing apparatus is adapted to operate during operation of the bucket. The dust suppressing apparatus functions to reduce dust emissions during use of the bucket. Particular embodiments include the dust suppressing apparatus automatically operating in response to operation of the bucket.

6 Claims, 7 Drawing Sheets

BUCKET WITH DUST SUPPRESSING APPARATUS

BACKGROUND OF THE INVENTION

1. Technical Field

This invention relates generally to a dust suppressing apparatus and more particularly to a bucket with an apparatus for suppressing dust and assisting in material processing.

2. State of the Art

The construction industry has wide spread use of buckets such as excavator buckets. The use of excavator buckets is particularly prevalent in pipeline and underground utility construction. Workers are required to move large amounts of soil in order to place a pipeline properly under the ground, or to properly install underground utilities and lines. The digging, cutting and material processing of the soil often times results in the emissions of dust.

Many state governments have a desire to control the emissions that they deem harmful or hazardous to the general public. States have often found that dust emissions from construction sites are one of the emissions that need control. They have set limits on the amount of dust emissions from any particular site and govern this by placing heavy fines on the construction company for violating the maximum dust emissions established by the state.

Conventional devices for controlling dust emissions include the use of water trucks. These water trucks carry large tanks of water and include a spray device. The water trucks drive systematically around the construction site and spray it down with water. The water spray serves to reduce the dust in the air and keeps dust emissions levels within the desired range established by the state.

These conventional devices have their drawbacks. One drawback is that the water truck is another piece of equipment and often times multiple pieces of equipment that a construction company must provide either by ownership or rental. Another drawback is that the trucks utilize a large amount of water in order to keep the dust emissions within the established levels. Yet another drawback is the additional costs for supplying the truck, the water and the additional labor for operating the truck. Further, the water truck lacks efficiency since it is trying to reduce emissions after the dust has already been emitted within the air.

Accordingly, there is a need in the field of dust suppressing devices for an improved bucket with a dust suppression apparatus.

DISCLOSURE OF THE INVENTION

The present invention relates to a bucket with a dust suppressing apparatus. Generally, a bucket with a dust suppressing apparatus comprises a bucket having a bucket portion and a dust suppressing apparatus coupled to the bucket portion. The dust suppressing apparatus functions to reduce dust emissions during use of the bucket.

An aspect of the present invention includes a bucket with a dust suppressing apparatus comprising a bucket portion and a dust suppressing apparatus coupled to the bucket portion. The dust suppressing apparatus adapted to operate during operation of the bucket.

Another aspect of the present invention includes a mechanical bucket with a dust suppressing apparatus comprising a bucket portion coupled to a screen assembly and a dust suppressing apparatus coupled to the bucket portion in a position adjacent the screen assembly. The dust suppressing apparatus is adapted to operate during operation of the mechanical bucket.

Yet another aspect of the present invention includes a method of using a bucket with a dust suppressing apparatus comprising coupling a bucket with a dust suppressing apparatus to material handling machinery; connecting the dust suppressing apparatus to a water supply; operating the dust suppressing apparatus in response to operation of the bucket; and suppressing dust.

The foregoing and other features and advantages of the present invention will be apparent from the following more detailed description of the particular embodiments of the invention, as illustrated in the accompanying drawings.

BRIEF DESCRIPTION OF THE DRAWINGS

The invention will hereinafter be described in conjunction with the appended drawings where like designations denote like elements, and.

DETAILED DESCRIPTION OF EMBODIMENTS OF THE INVENTION

As discussed above, embodiments of the present invention relate to a bucket with a dust suppressing apparatus. Generally, a bucket with a dust suppressing apparatus comprises a bucket having a bucket portion and a dust suppressing apparatus coupled to the bucket portion. The dust suppressing apparatus functions to reduce dust emissions during use of the bucket.

Figure 1:
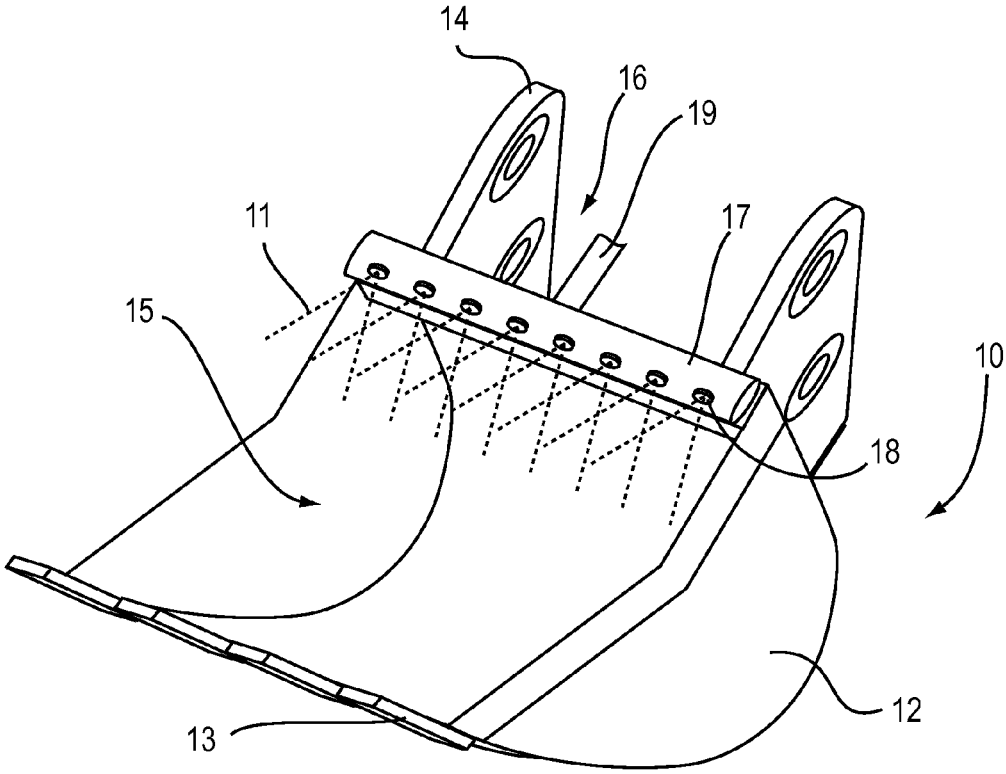
FIG. 1 is a perspective view of an excavator bucket with a dust suppressing apparatus in accordance with the present invention.
Figure 2:
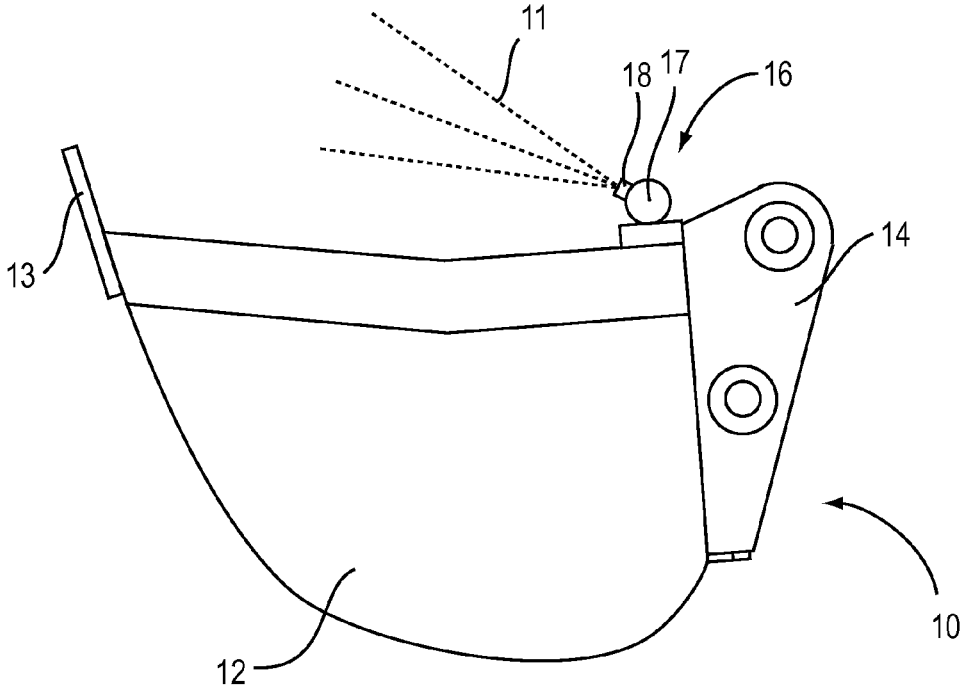
FIG. 2 is a side view of a excavator bucket with a dust suppressing apparatus.

Referring to the drawings, FIGS. 1 and 2 depict an excavator bucket 10 with a dust suppressing apparatus 16. The excavator bucket 10 comprises a bucket portion 12 having a cutting edge 13 and ears 14 for mounting to a material handling machinery. The bucket portion 12 may also include a recess 15 for receiving and retaining material, such as soil. The excavator bucket 10 is used by material handling machinery to move material from a first location by scooping or otherwise collecting the material into the recess 15 of the bucket portion 12 and transporting the material to a second location and depositing the material in the second location. The cutting edge 13 may be used to cut into particular material, such as into a mound of soil or directly into the ground.

The dust suppressing apparatus comprises a tube portion 17 having nozzles 18. The tube portion 17 is adapted to receive a fluid, such as water, within the tube portion 17. The nozzles 18 are adapted to allow water to travel out of the tube portion 17 through the nozzles 18. The water may be in the form a mist 11 or spray 11. According to particular embodiments of the present invention, the nozzles 18 may be misting nozzles. It will be understood that while particular embodiments incorporate misting nozzles, the nozzles 18 may any type of nozzle, such as, but not limited to water sprayers. The nozzles 18 provide a means to mist or spray water out of the tube portion 17 of the dust suppressing apparatus 16. The dust suppressing apparatus may also include connector tube 19 adapted to connect to water source 22 (see FIGS. 3 and 4). This allows fluid communication between the dust suppressing apparatus 16 and the water source 22.

The dust suppressing apparatus 16 may be coupled to the bucket portion 12 of the excavator bucket 10. In particular embodiments, the dust suppressing apparatus 16 may be coupled to the bucket portion 12 adjacent the ear 14 of the excavator bucket 10. Further, the dust suppressing apparatus 16 may be coupled adjacent an opening of the recess 15 of the bucket portion 12. In this configuration, the dust suppressing apparatus 16 is always misting or spraying water in the area adjacent the recess 15 where the majority of the dust emissions are coming from. For example, but without limitation, in this configuration, if the excavator bucket 10 is used with the cutting edge 13 digging into a material 25, such as soil, dust would be created by the cutting edge 13 in cutting the soil material and also dust created by the scooping of material into the bucket portion 12. The dust suppressing apparatus 16 is able to mist or spray water 11 directly in the area and source of the dust creation and is able to prevent the dust from emitting further into the air and result in prevention of dust emissions at the source of the dust creation.

The dust suppressing apparatus 16 is adapted to operate during operation of the excavator bucket. In particular embodiments, the dust suppressing apparatus 16 is adapted to automatically operate in response to operation of the excavator bucket 10.

While it is shown that the dust suppressing apparatus 16 is coupled adjacent the opening of the recess 15 of the bucket portion 12, the dust suppressing apparatus may be coupled to any portion of the excavator bucket 10, so long as the dust suppressing apparatus 16 allows for misting or spraying of water toward the source of the dust creation of the excavator bucket 10. It will further be understood that particular embodiments may employ a plurality of dust suppressing devices 16 each coupled to the excavator bucket 10.

It will be understood that the dust suppressing apparatus 16 utilizes less water than is required by the conventional water trucks. The dust suppressing apparatus 16 operates as the source of the dust creation and requires less water to reduce the emissions of the dust that is created by the operation of the excavator bucket. Further, by using misting nozzles or other spray nozzles that provide for finer sprays, the amount of water used to suppress the dust emissions is reduced.

It will also be understood that the dust suppressing apparatus 16 may be coupled to any type of excavator bucket including, but not limited to, a standard excavator bucket, an excavator bucket with agitators, a padding excavator bucket, a material crushing excavator bucket, an excavator bucket with a roller screen, a screening bucket, and the like.

Figure 4:
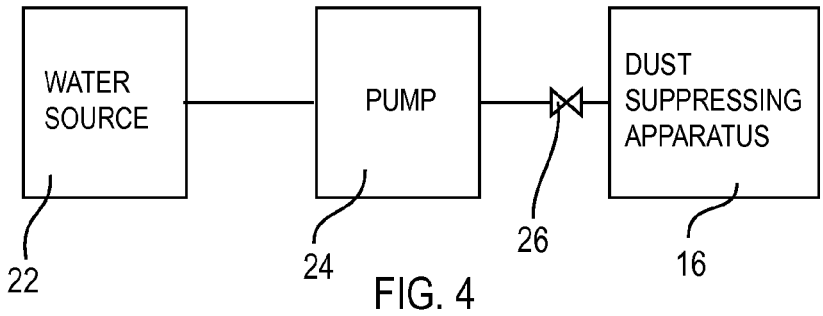
FIG. 4 is a schematic view of a dust suppressing apparatus in accordance with the present invention.

With additional reference to the drawings, FIG. 4 depicts the dust suppressing apparatus 16 coupled to a water source 22 in accordance with particular embodiments of the present invention. The water source 22 may be in fluid communication with the dust suppressing apparatus 16. This communication allows for the flow of water from the tank into the tube portion 17 of the dust suppressing apparatus 16 and out of the nozzles 18. In order to produce the water flow from the water source 22 and out of the dust suppressing apparatus 16, a pump 24 may be coupled between the water source 22 and the dust suppressing apparatus 16, the pump 24 in fluid communication with each the water source 22 and the dust suppressing apparatus 16. The pump 22 pumps the water from the water source 22 to the dust suppressing apparatus 16 with enough pressure to expel the water out of the dust suppressing apparatus 16. Embodiments of the present invention may further comprise an override valve 26 coupled between the pump 24 and the dust suppressing apparatus 16. The override valve 26 may be adapted to prevent operation of the dust suppressing apparatus 16 when water pressure is below a predetermined level.

Figure 3:
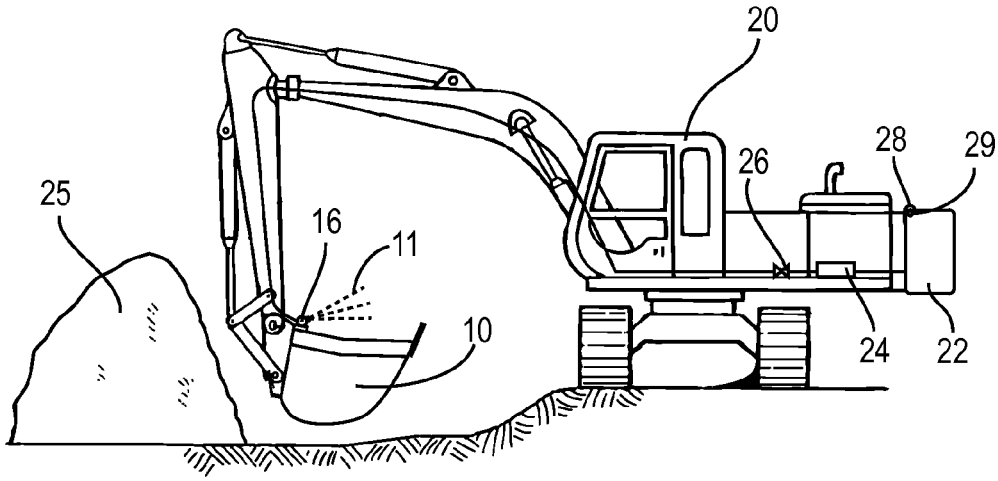
FIG. 3 is a side view of a material handling machinery with a dust suppressing apparatus according to the present invention.

Referring again to the drawings, FIG. 3 depicts a material handling machinery 20 with an excavator bucket having a dust suppressing apparatus 16 in accordance with particular embodiments of the present invention. The machinery 20 may include a water source 22, such as a water tank, coupled to the machinery 20 by use of existing brackets 28 and a pin 29. The water tank may be fillable while coupled to the machinery 20. The machinery may also include a pump 24 coupled to the machinery 20. The water source 22 may be in fluid communication with the dust suppressing apparatus 16. This communication allows for the flow of water from the tank into the tube portion 17 of the dust suppressing apparatus 16 and out of the nozzles 18. In order to produce the water flow from the water source 22 and out of the dust suppressing apparatus 16, a pump 24 may be coupled between the water source 22 and the dust suppressing apparatus 16, the pump 24 in fluid communication with each of the water source 22 and the dust suppressing apparatus 16. The pump 22 pumps the water from the water source 22 to the dust suppressing apparatus 16 with enough pressure to expel the water out of the dust suppressing apparatus 16. Embodiments of the present invention may further comprise an override valve 26 coupled between the pump 24 and the dust suppressing apparatus 16. The override valve 26 may be adapted to prevent operation of the dust suppressing apparatus 16 when water pressure is below a predetermined level.

In operation, the machinery 20 may be used to move or transfer material from location to another, during operation of the machinery and the excavator bucket 10, the dust suppressing apparatus 16 operates to suppress dust emission created by the movement or transfer of material such as soil.

As previously described, the excavator bucket 10 comprises a bucket portion 12 having a cutting edge 13 and ears 14 for mounting to a material handling machinery. The bucket portion 12 may also include a recess 15 for receiving and retaining material, such as soil. The excavator bucket 10 is used by material handling machinery to move material from a first location by scooping or otherwise collecting the material into the recess 15 of the bucket portion 12 and transporting the material to a second location and depositing the material in the second location. The cutting edge 13 may be used to cut into particular material, such as into a mound of soil or directly into the ground.

Also as previously described, the dust suppressing apparatus comprises a tube portion 17 having nozzles 18. The tube portion 17 is adapted to receive a fluid, such as water, within the tube portion 17. The nozzles are adapted to allow water to travel out of the tube through the nozzles 18. According to particular embodiments of the present invention, the nozzles 18 may be misting nozzles. It will be understood that while particular embodiments incorporate misting nozzles, the nozzles 18 may be any type of nozzle, such as, but not limited to water sprayers. Water spray nozzles are understood to not include as fine of spray as a misting nozzle. The nozzles 18 provide a means to mist or spray water out of the tube portion 17 of the dust suppressing apparatus 16.

The dust suppressing apparatus 16 may be coupled to the excavator bucket 10. In particular embodiments, the dust suppressing apparatus 16 may be coupled to the bucket portion 12 adjacent the ear 14 of the excavator bucket. Further, the dust suppressing apparatus 16 may be coupled adjacent an opening of the recess 15 of the bucket portion 12. In this configuration, the dust suppressing apparatus 16 is always misting or spraying water in the area adjacent the recess 15 where the majority of the dust emissions are coming from. For example, but without limitation, in this configuration, if the excavator bucket 10 is used with the cutting edge 13 digging into a trench, dust would be created by the cutting edge in cutting the soil material and also dust created by the scooping of material into the bucket portion 12. The dust suppressing apparatus 16 is able to mist or spray water directly in the area and source of the dust creation and is able to prevent the dust from emitting further into the air and result in prevention of dust emissions at the source of the dust creation.

In particular embodiments of the machinery 20, the dust suppressing apparatus 16 may also be mechanically coupled to the hydraulic motor of the machinery 20, wherein the hydraulic motor provides the power to operate the dust suppressing apparatus 16. This may be accomplished by the hydraulic motor operating the pump 24.

The dust suppressing apparatus 16 is adapted to operate during operation of the excavator bucket. In particular embodiments, the dust suppressing apparatus 16 is adapted to automatically operate in response to operation of the excavator bucket 10.

Figure 10:
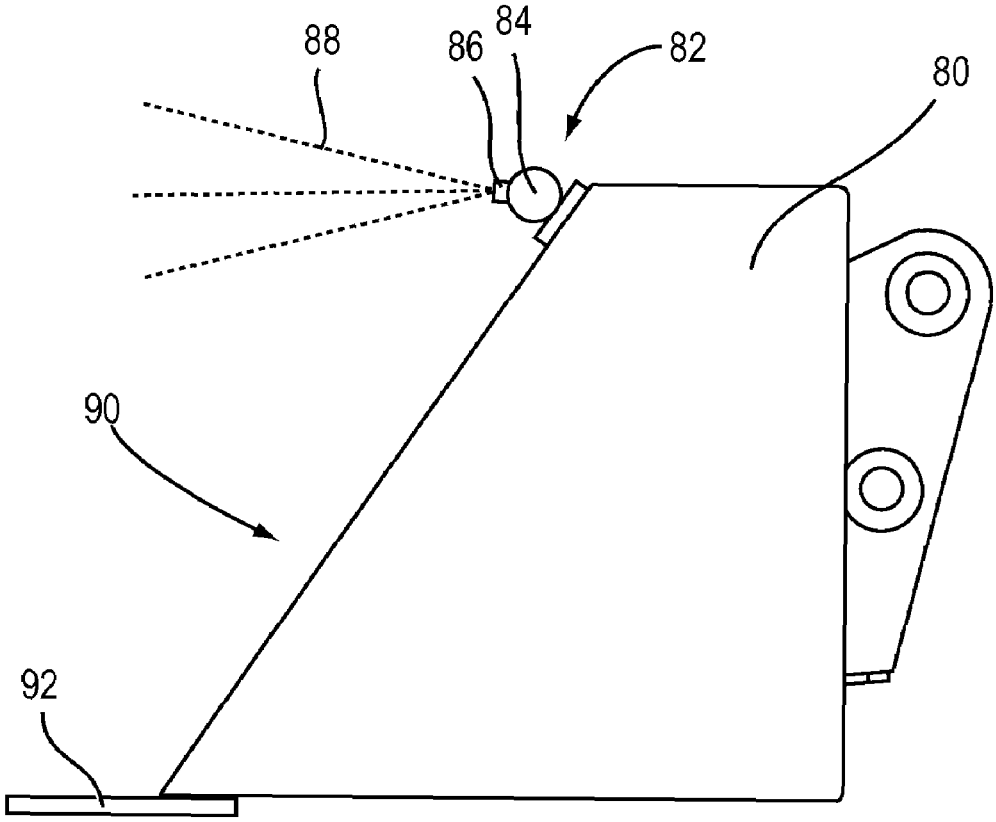
FIG. 10 is a side view of a front loader bucket with a dust suppressing apparatus.

It will be understood that the machinery 20 may be any type of machinery that requires the use of a bucket, such as but not limited to an excavator, a back hoe, an end loader, a front loader, a bobcat, and the like. For example, and without limitation. FIG. 10 depicts a front loader bucket 80 having a dust suppressing apparatus 82. The dust suppressing apparatus 82 comprises a tube portion 84 having nozzles 86. The tube portion 84 is adapted to receive a fluid, such as water, within the tube portion 84. The nozzles 86 are adapted to allow water to travel out of the tube through the nozzles 86. The water may be in the form of a mist 88 or spray 88. According to particular embodiments of the present invention, the nozzles 86 may be misting nozzles. It will be understood that while particular embodiments incorporate misting nozzles, the nozzles 86 may be any type of nozzle, such as, but not limited to water sprayers. Water spray nozzles are understood to not include as fine of spray as a misting nozzle. The nozzles 86 provide a means to mist or spray water out of the tube portion 84 of the dust suppressing apparatus 82. The dust suppressing apparatus may also include a connector tube (not shown) (similar to that shown in FIGS. 3 and 4) adapted to connect to a water source. This allows fluid communication between the dust suppressing apparatus 82 and the water source.

The dust suppressing apparatus 82 may be coupled to the front loader bucket portion 80 adjacent an opening 90 for receiving material therein. In this configuration, the dust suppressing apparatus 82 is always misting or spraying water in the area adjacent the opening 90 where the majority of the dust emissions are coming from. For example, but without limitation, in this configuration, if the front loader bucket 80 is used with the cutting edge 92 to dig into a material, such as soil, dust would be created by the cutting edge 92 in cutting the soil material and also dust created by the scooping of material into the opening 90. The dust suppressing apparatus 82 is able to mist or spray water 88 directly in the area and source of the dust creation and is able to prevent the dust from emitting further into the air and result in prevention of dust emissions at the source of the dust creation.

The dust suppressing apparatus 82 is adapted to operate during operation of the front loader bucket. In particular embodiments, the dust suppressing apparatus 82 is adapted to automatically operate in response to operation of the front loader bucket 80.

Figure 5:
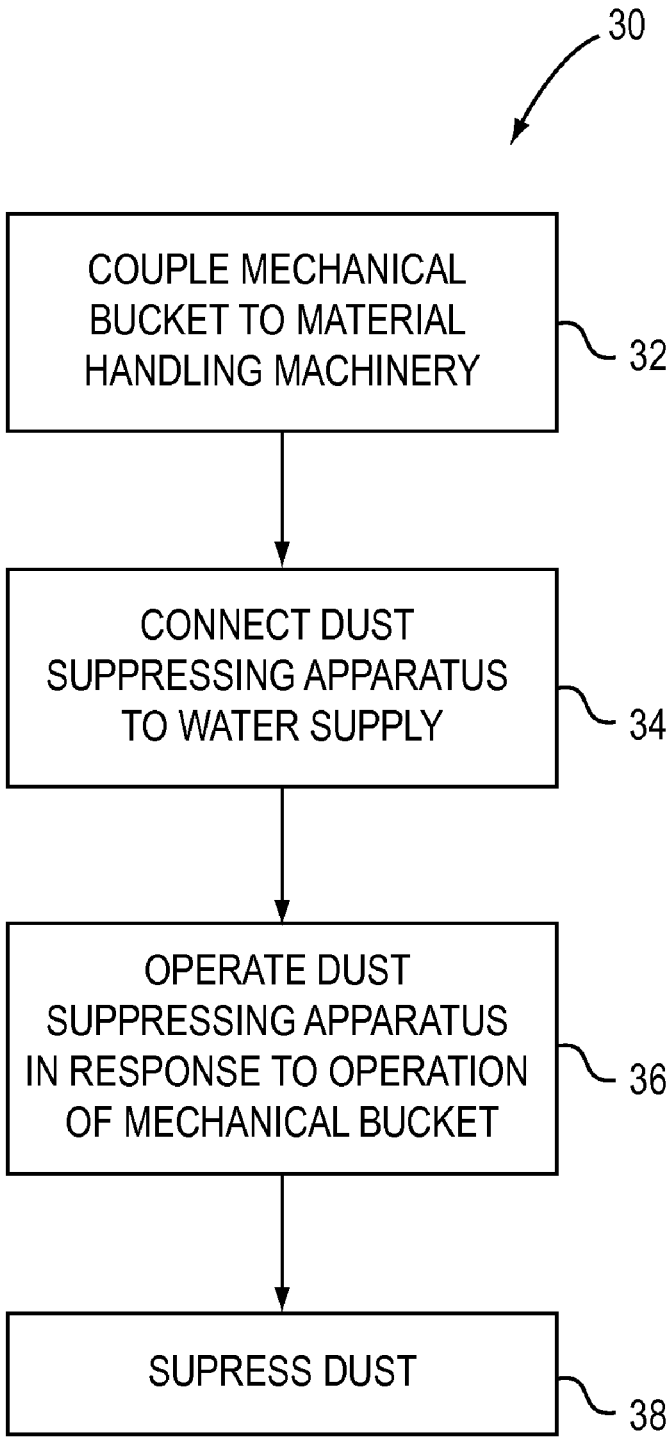
FIG. 5 is a flow chart of a method of using a bucket with a dust suppressing apparatus.

Referring again to the drawings, FIG. 5 depicts a flow chart of a method 30 of using a bucket with a dust suppressing apparatus. The method may include the steps of coupling a bucket with a dust suppressing apparatus to material handling machinery (Step 32); connecting the dust suppressing apparatus to a water supply (Step 34); operating the dust suppressing apparatus in response to operation of the bucket (Step 36); and suppressing dust (Step 38). The method 30 may further comprise the step of maintaining operation of the dust suppressing apparatus for the duration of operation of the bucket.

Figure 6:
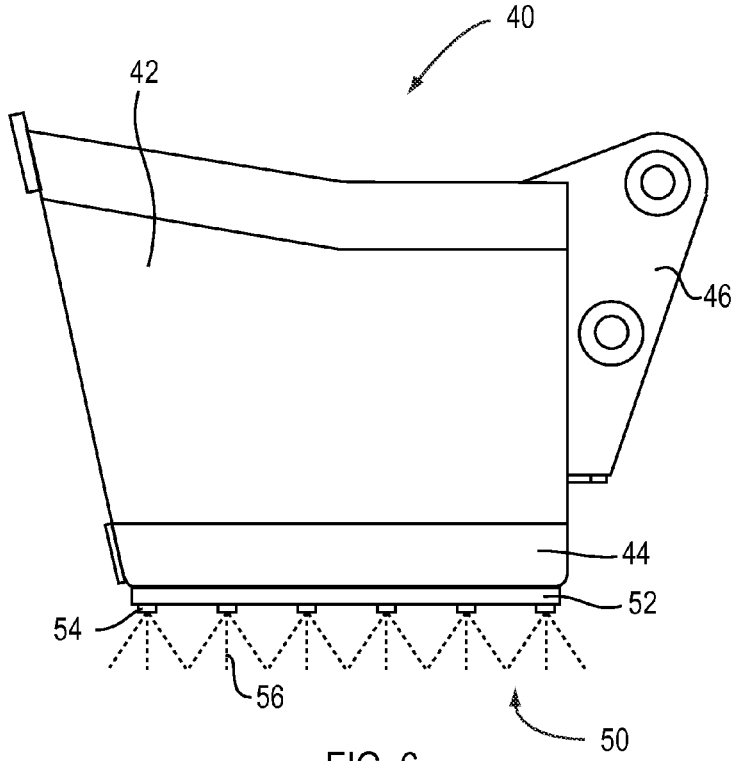
FIG. 6 is a side view of a mechanical bucket with a dust suppressing apparatus.
Figure 7:
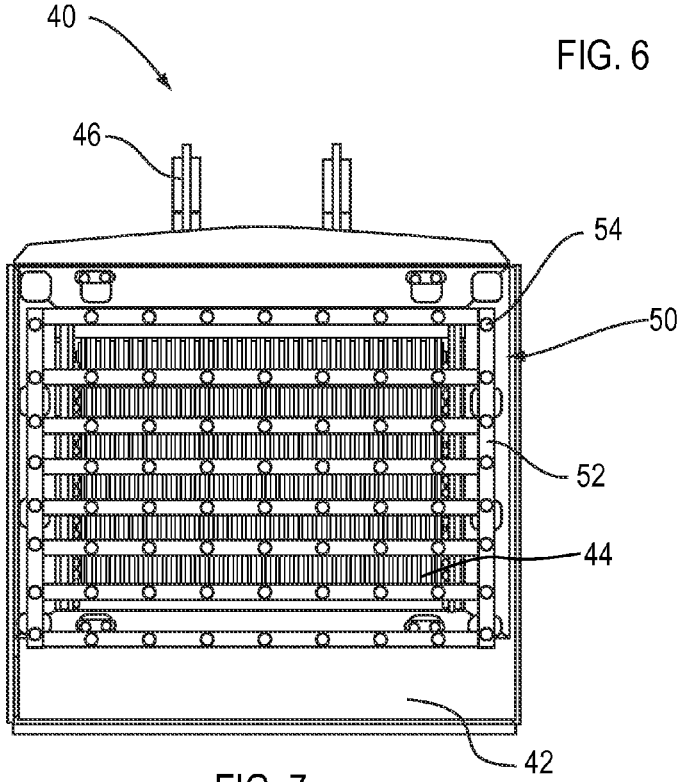
FIG. 7 is a bottom view of a mechanical bucket with a dust suppressing apparatus.

Another embodiment of the present invention is shown in FIGS. 6-7. FIGS. 6-7 depict a mechanical bucket 40 with a dust suppressing apparatus 50. The mechanical bucket 40 comprises a bucket portion 42 having ears 46 for mounting to a material handling machinery. The mechanical bucket 40 is used by material handling machinery to move material from a first location by scooping or otherwise collecting the material into the bucket portion 42 and transporting the material to a second location and depositing the material in the second location by use of a screen assembly 44. The screen assembly 44 of a mechanical bucket may be a roller screen assembly or any other type of screening assembly.

The dust suppressing apparatus 50 comprises at least one tube portion 52 having nozzles 54. The tube portion 50 is adapted to receive a fluid, such as water, within the tube portion 50. The nozzles 54 are adapted to allow water to travel out of the tube through the nozzles 54. The water may be in the form a mist 56 or spray 56. According to particular embodiments of the present invention, the nozzles 54 may be misting nozzles. It will be understood that while particular embodiments incorporate misting nozzles, the nozzles 54 may any type of nozzle, such as, but not limited to water sprayers. Water spray nozzles are understood to not include as fine of spray as a misting nozzle. The nozzles 54 provide a means to mist or spray water 56 out of the tube portion 52 of the dust suppressing apparatus 50. The dust suppressing apparatus may also include a connector tube (not shown) adapted to connect to water source 22 (see FIG. 9). This allows fluid communication between the dust suppressing apparatus 50 and the water source 22.

The dust suppressing apparatus 50 may be coupled to the bucket portion 42 of the mechanical bucket 40. In particular embodiments, the dust suppressing apparatus 50 may be coupled to the bucket portion 42 adjacent the screen assembly 44 of the mechanical bucket, or overlaying the screen assembly 44. In this configuration, the dust suppressing apparatus 50 is always misting or spraying water 50 in the area adjacent the screen assembly 44 where the majority of the dust emissions are coming from. For example, but without limitation, in this configuration, if the mechanical bucket 40 is used to screen material through the screen assembly 44, dust would be created by the screen assembly 44. The dust suppressing apparatus 50 is able to mist or spray water 56 directly in the area and source of the dust creation and is able to prevent the dust from emitting further into the air and result in prevention of dust emissions at the source of the dust creation. Further, the dust suppressing apparatus 50 may be coupled adjacent an opening of the recess of the bucket portion 42.

The dust suppressing apparatus 50 is adapted to operate during operation of the mechanical bucket 40. In particular embodiments, the dust suppressing apparatus 50 is adapted to automatically operate in response to operation of the mechanical bucket 40.

While it is shown that the dust suppressing apparatus 50 is coupled adjacent the opening of the screen assembly 44 of the bucket portion 42, the dust suppressing apparatus may be coupled to any portion of the mechanical bucket 40, so long as the dust suppressing apparatus 50 allows for misting or spraying of water toward the source of the dust creation of the mechanical bucket 40. It will further be understood that particular embodiments may employ a plurality of dust suppressing devices 50 each coupled to the mechanical bucket 40.

It will be understood that the dust suppressing apparatus 50 utilizes less water than is required by the conventional water trucks. The dust suppressing apparatus 50 operates at the source of the dust creation and requires less water to reduce the emissions of the dust that is created by the operation of the mechanical bucket. Further, by using misting nozzles or other spray nozzles that provide for finer sprays, the amount of water used to suppress the dust emissions is reduced.

Figure 8:
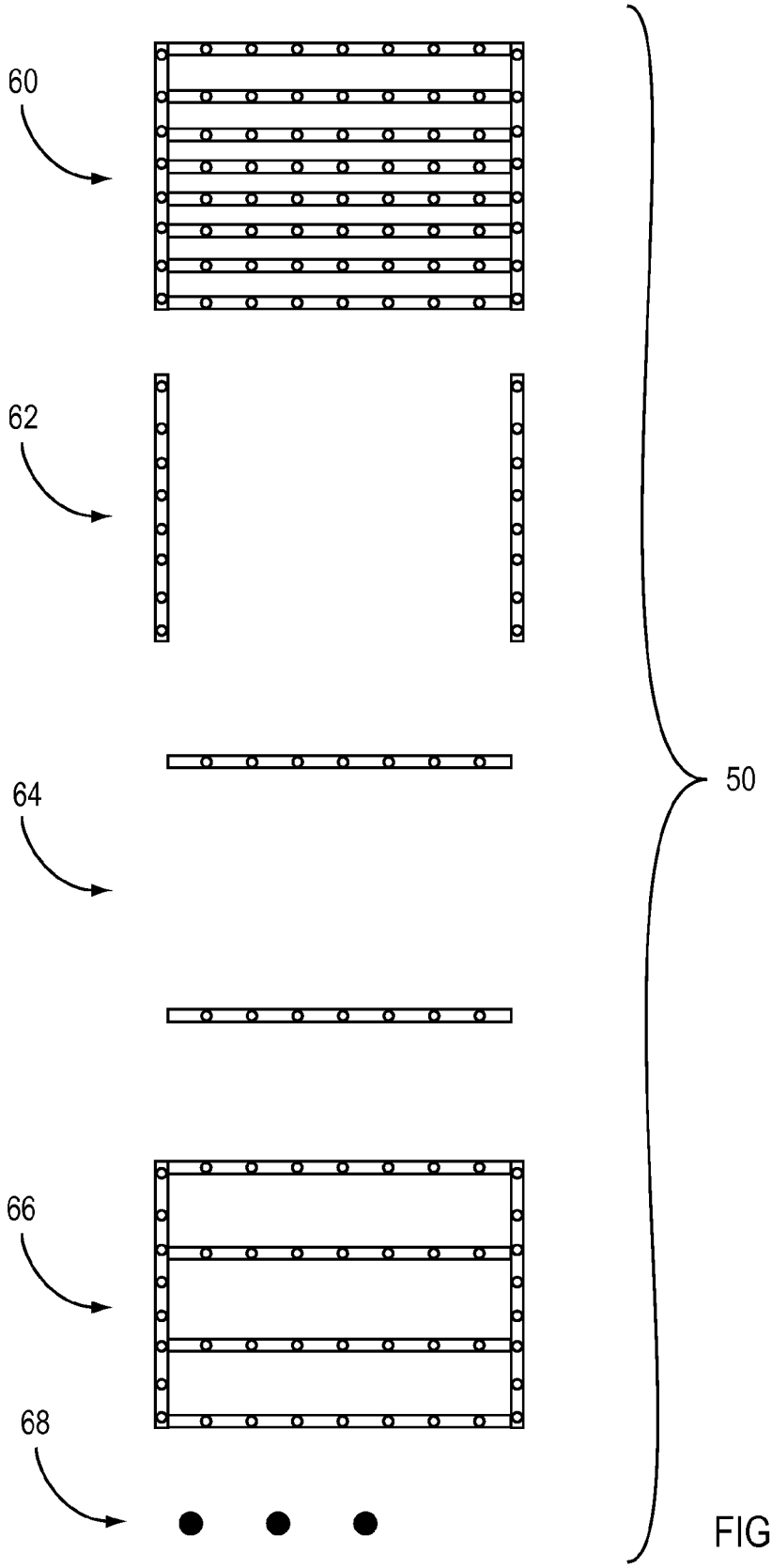
FIG. 8 is a bottom view of various configurations of a dust suppressing apparatus for use with a mechanical bucket.

It will also be understood that the dust suppressing apparatus 50 may comprise various types of configurations, as shown in FIG. 8. The dust suppressing apparatus 50 may have a first configuration 60 configuration of multiple cross members coupled to two side members; a second configuration 62 with one or two cross members oriented in a first particular direction; a third configuration 64 with one or two cross members oriented in a second particular direction; a fourth configuration 66 with the multiple cross members coupled to two side members wherein the number of cross members is less than the first configuration and an number of additional configurations 68 that allow for the mechanical bucket 40 to operate properly and further allows the dust suppressing apparatus 50 to operate properly.

Figure 9:
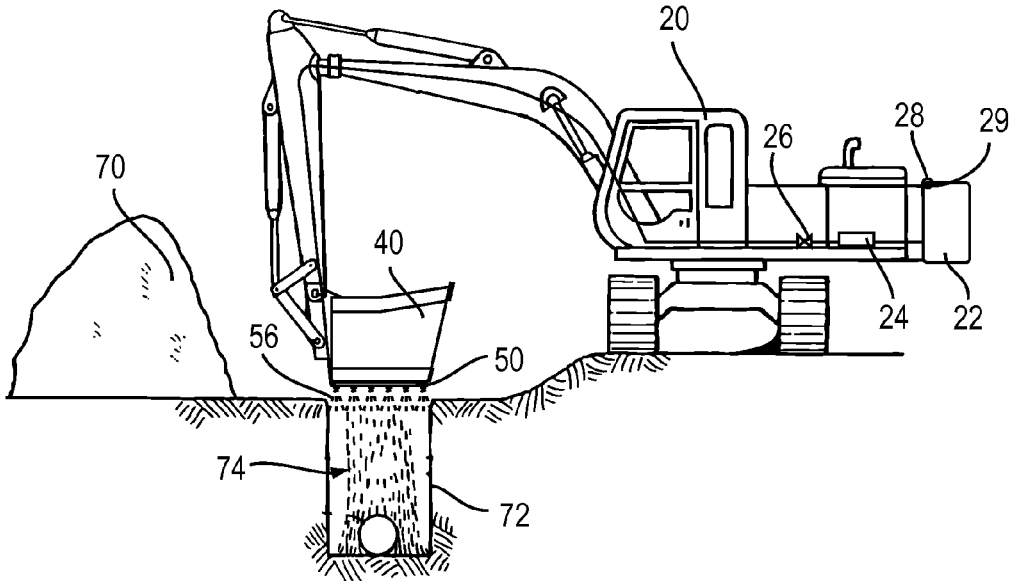
FIG. 9 is a side view of a material handling machinery with a mechanical bucket having a dust suppressing apparatus according to the present invention.

FIG. 9 further depicts a material handling machinery 20 with an mechanical bucket 40 having a dust suppressing apparatus 50 in accordance with particular embodiments of the present invention. The machinery 20 may include a water source 22, such as a water tank, coupled to the machinery 20 by use of existing brackets 28 and a pin 29. The water tank may be fillable while coupled to the machinery 20. The machinery may also include a pump 24 coupled to the machinery 20. The water source 22 may be in fluid communication with the dust suppressing apparatus 50. This communication allows for the flow of water from the tank into the tube portion 52 of the dust suppressing apparatus 50 and out of the nozzles 54. This flow of water may comprise a mist 56 or spray 56. In order to produce the water flow from the water source 22 and out of the dust suppressing apparatus 50, a pump 24 may be coupled between the water source 22 and the dust suppressing apparatus 50, the pump 24 in fluid communication with each the water source 22 and the dust suppressing apparatus 50. The pump 22 pumps the water from the water source 22 to the dust suppressing apparatus 50 with enough pressure to expel the water out of the dust suppressing apparatus 50. Embodiments of the present invention may further comprise an override valve 26 coupled between the pump 24 and the dust suppressing apparatus 50. The override valve 26 may be adapted to prevent operation of the dust suppressing apparatus 50 when water pressure is below a predetermined level.

In operation, the machinery 20 may be used to move or transfer material from location to another, during operation of the machinery and the mechanical bucket 40, the dust suppressing apparatus 50 operates to suppress dust emission created by the movement or transfer of material such as soil. For example, the machinery 20 may be used to move material from the material pile 70 into the trench 72, wherein the mechanical bucket 40 is adapted to screen material 74 through the screen assembly 44 of the mechanical bucket 40.

As previously described, the mechanical bucket 40 comprises a bucket portion 42 having ears 46 for mounting to a material handling machinery. The bucket portion 42 may also be adapted to receive and retain material, such as soil, within the bucket portion 42. The mechanical bucket 40 is used by material handling machinery to move material from a first location by scooping or otherwise collecting the material into the bucket portion 42 and transporting the material to a second location and depositing the material in the second location.

The dust suppressing apparatus 50 comprises a tube portion 52 having nozzles 54. The tube portion 52 is adapted to receive a fluid, such as water, within the tube portion 52. The nozzles are adapted to allow water to travel out of the tube through the nozzles 54. According to particular embodiments of the present invention, the nozzles 54 may be misting nozzles. It will be understood that while particular embodiments incorporate misting nozzles, the nozzles 54 may any type of nozzle, such as, but not limited to water sprayers. The nozzles 54 provide a means to mist or spray water out of the tube portion 52 of the dust suppressing apparatus 50.

The dust suppressing apparatus 50 may be coupled to the mechanical bucket 40. In particular embodiments, the dust suppressing apparatus 50 may be coupled to the bucket portion 42 adjacent the screen assembly 44 of the mechanical bucket 40. In this configuration, the dust suppressing apparatus 50 is always misting or spraying water 56 in the area adjacent the screen assembly 44 where the majority of the dust emissions are coming from. For example, but without limitation, in this configuration, if the mechanical bucket 40 is used with screen assembly depositing material 74 into a trench 72, dust would be created by screen assembly and the deposit of the material 74 in the trench 72. The dust suppressing apparatus 50 is able to mist or spray water 56 directly in the trench 72 area and source of the dust creation and is able to prevent the dust from emitting further into the air and result in prevention of dust emissions at the source of the dust creation.

In particular embodiments of the machinery 20, the dust suppressing apparatus 50 may also be mechanically coupled to the hydraulic motor of the machinery 20, wherein the hydraulic motor provides the power to operate the dust suppressing apparatus 50. This may be accomplished by the hydraulic motor operating the pump 24.

The dust suppressing apparatus 50 is adapted to operate during operation of the mechanical bucket. In particular embodiments, the dust suppressing apparatus 50 is adapted to automatically operate in response to operation of the mechanical bucket 40.

It will be understood that the machinery 20 may be any type of machinery that requires the use of a mechanical bucket.

It will also be understood that the method shown in FIG. 5 is also adaptable for use with the embodiment of a mechanical bucket 40 with a dust suppressing apparatus 50 as shown in FIGS. 6-9.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

For example the components defining any bucket with dust suppressing apparatus implementation may be formed of any of many different types of materials or combinations thereof that can readily be formed into shaped objects provided that the components selected are consistent with the intended operation of a bucket with dust suppressing apparatus implementation. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any bucket with dust suppressing apparatus implementation may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The invention claimed is:

1. A bucket with a dust suppressing apparatus comprising:

a bucket portion, said bucket portion being coupled to a screen assembly;

a dust suppressing apparatus directly coupled to the bucket portion, wherein the dust suppressing apparatus is adapted to operate during operation of the bucket a fluid source;

a pump coupled between the fluid source and the dust suppressing apparatus, the pump in fluid communication with each of the fluid source and the dust suppressing apparatus; and an override valve coupled between the pump and the dust suppressing apparatus, the override valve adapted to prevent operation of the dust suppressing apparatus when fluid pressure is below a predetermined level.

2. The apparatus of claim 1, wherein the dust suppressing apparatus further comprises a tube portion and a plurality of nozzles.

3. The apparatus of claim 2, wherein the plurality of nozzles comprise misting nozzles.

4. The apparatus of claim 2, wherein the plurality of nozzles comprise water sprayers.

5. The apparatus of claim 1, wherein said fluid source is a water source in fluid communication with the dust suppressing apparatus.

6. The apparatus of claim 1, wherein the dust suppressing apparatus is adapted to operate in response to operation of the bucket.

* * * * *